US012326082B1

(12) United States Patent
Gar et al.

(10) Patent No.: US 12,326,082 B1
(45) Date of Patent: Jun. 10, 2025

(54) TRACKING A WIPER DART HAVING A BI-DIAMETER WIPER CUP IN A WELLBORE USING PRESSURE SPIKES

(71) Applicant: Halliburton Energy Services, Inc., Houston, TX (US)

(72) Inventors: Shobeir Pirayeh Gar, Houston, TX (US); Lonnie Carl Helms, Houston, TX (US); Gavin Graff, Golden, CO (US); Ricky Layne Covington, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/430,873

(22) Filed: Feb. 2, 2024

(51) Int. Cl.
*E21B 47/095* (2012.01)
*E21B 23/04* (2006.01)
*E21B 33/16* (2006.01)

(52) U.S. Cl.
CPC ..... *E21B 47/095* (2020.05); *E21B 23/04* (2013.01); *E21B 33/165* (2020.05)

(58) Field of Classification Search
CPC ..... E21B 47/095; E21B 23/04; E21B 33/165
See application file for complete search history.

(56) References Cited

U.S. PATENT DOCUMENTS 4,378,838 A 4/1983 Ogden et al.
4,671,358 A * 6/1987 Lindsey, Jr. ..... E21B 34/14 166/291
4,819,726 A * 4/1989 Beirute ..... E21B 33/16 166/291
4,951,751 A * 8/1990 Jennings, Jr. ..... E21B 33/138 166/291
6,067,682 A * 5/2000 Rankin ..... B08B 9/0557 15/104.061
12,065,925 B2 * 8/2024 Demidov ..... E21B 33/165
2012/0234561 A1 * 9/2012 Hall ..... E21B 23/02 166/386
2013/0112410 A1 * 5/2013 Szarka ..... E21B 33/165 166/135
2014/0338896 A1 * 11/2014 McGarian ..... E21B 47/10 166/250.08
2018/0135378 A1 * 5/2018 Budde ..... E21B 23/04
2019/0128087 A1 * 5/2019 Stair ..... E21B 33/16
2021/0047898 A1 * 2/2021 Garcia ..... E21B 33/16
2021/0062640 A1 * 3/2021 Demidov ..... E21B 33/165
2021/0140275 A1 5/2021 Nanney et al.
2022/0220821 A1 7/2022 Budde
(Continued)

*Primary Examiner* — Steven A MacDonald
(74) *Attorney, Agent, or Firm* — Sheri Higgins Law, PLLC; Sheri Higgins

(57) ABSTRACT

A wiper dart having a bi-diameter wiper cup can be used to help track the location of the dart in a pipe string. As the wiper dart is pumped through the pipe string, a first mean pump pressure will exist as the wiper cup travels through drill pipe sections having a larger inner diameter than a tool joint and a second mean pump pressure will exist as the wiper cup travels through the tool joints. The wiper cup can have a geometric shape selected such that a detectable pressure spike can be observed when the wiper cup reaches a transition section located between one end of a pipe section and the tool joint. By counting the number of pressure spikes, an operator can accurately track the location of the wiper dart as it is being pumped through the pipe string.

20 Claims, 5 Drawing Sheets

(56) References Cited

U.S. PATENT DOCUMENTS

| | | | | |
|---|---|---|---|---|
| 2023/0084710 | A1* | 3/2023 | Lende | E21B 27/02<br>166/285 |
| 2023/0304395 | A1* | 9/2023 | Kabannik | E21B 47/06 |
| 2024/0410273 | A1* | 12/2024 | Demidov | E21B 47/095 |

* cited by examiner

TRACKING A WIPER DART HAVING A BI-DIAMETER WIPER CUP IN A WELLBORE USING PRESSURE SPIKES

TECHNICAL FIELD

A wiper dart can be used in a variety of wellbore operations. The wiper dart can have a single, bi-diameter wiper cup. The wiper cup can wipe the inside of tool joints and the inside of pipe sections of a tubing string.

BRIEF DESCRIPTION OF THE FIGURES

The features and advantages of certain embodiments will be more readily appreciated when considered in conjunction with the accompanying figures. The figures are not to be construed as limiting any of the embodiments.

DETAILED DESCRIPTION

Figure 2:
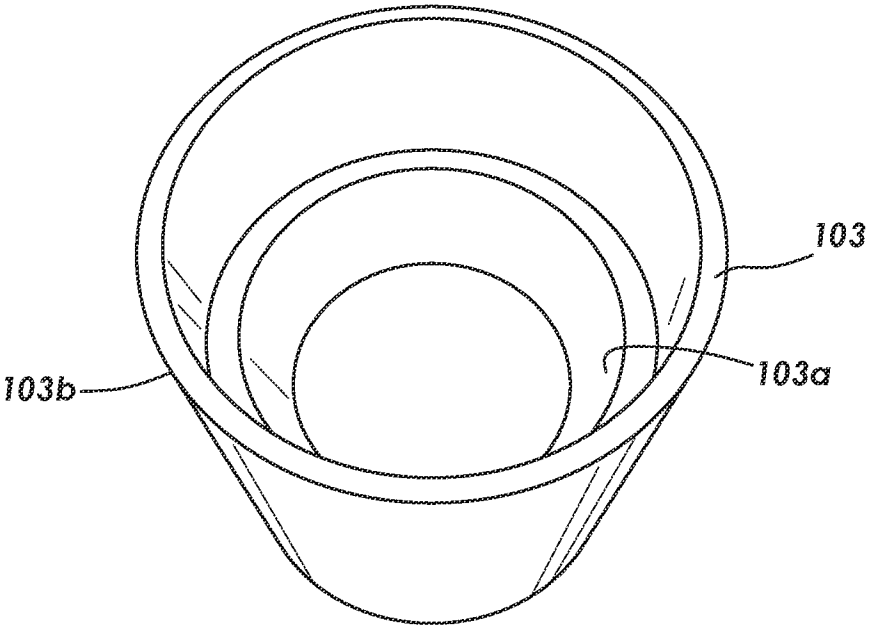
FIG. 2 is a perspective inside view of a tool joint according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water found in or produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore.

A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore. A cased-hole wellbore can also contain a tubing string. A wellbore can contain an annulus. Examples of an annulus include, but are not limited to, the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

During drilling operations, a wellbore is formed using a drill bit. A drill string can be used to aid the drill bit in drilling through a subterranean formation to form the wellbore. The drill string can include a drill pipe through which a drilling fluid or drilling mud is pumped. The wellbore defines a wellbore wall that is the exposed portion of the subterranean formation where the wellbore was formed. The drilling fluid may be circulated downwardly through the drill pipe and back up the annulus between the wellbore wall and the outside of the drill pipe.

Figure 1:
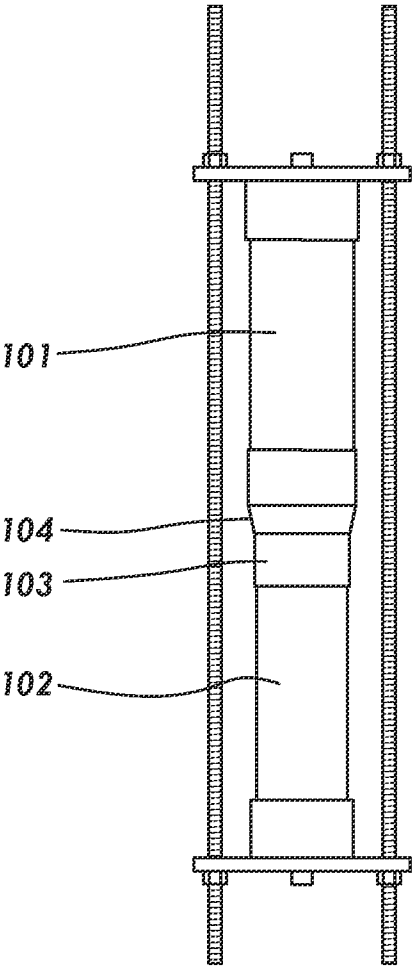
FIG. 1 is a front view of sections of a drill pipe with a tool joint according to certain embodiments.
Figure 5:
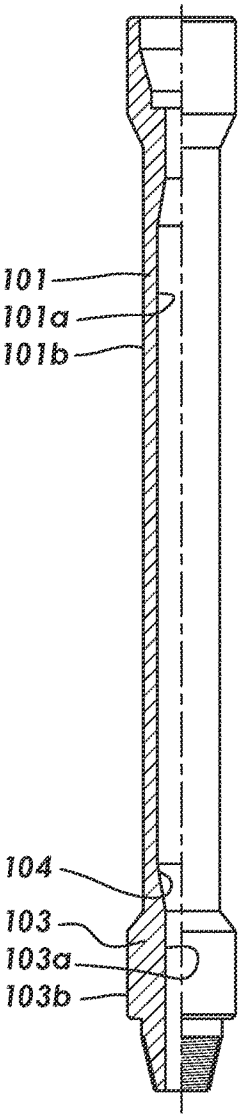
FIG. 5 is a cross-sectional view of a first section of drill pipe and tool joint showing variations in the inner diameter along the section and joint according to certain embodiments.
Figure 4:
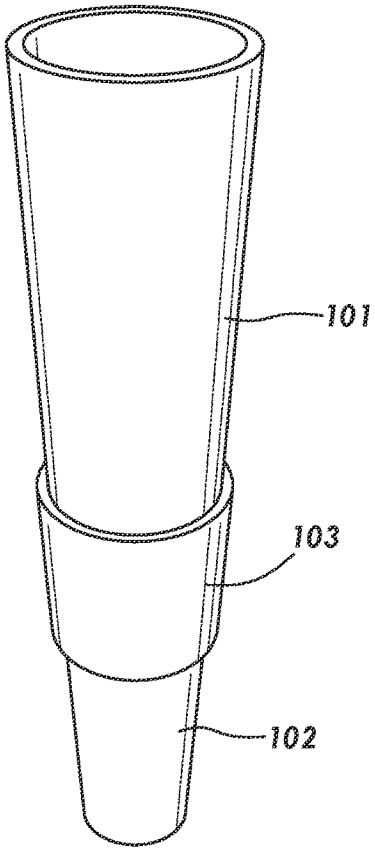
FIG. 4 is a front perspective view of both sections of drill pipe assembled with the tool joint according to certain embodiments.
Figure 3:
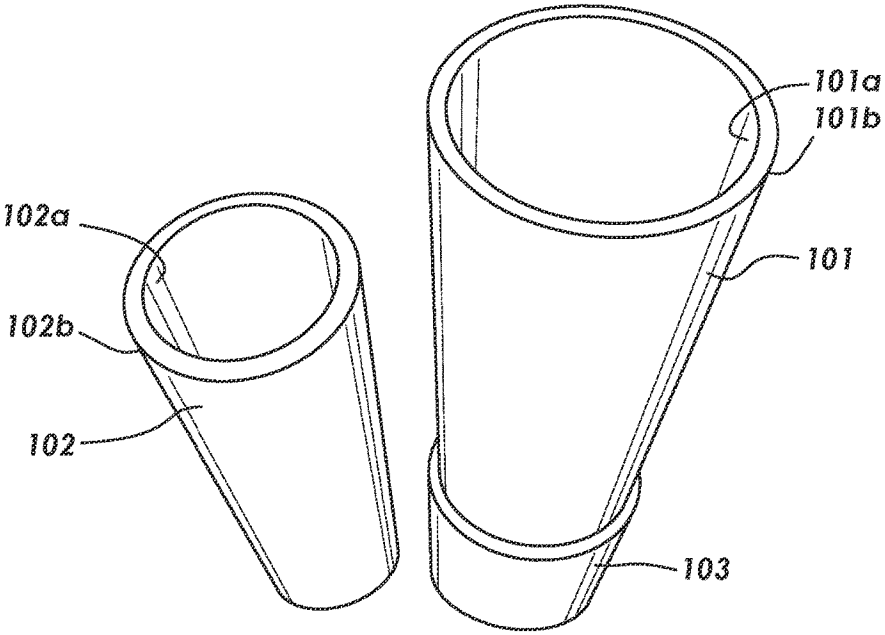
FIG. 3 is a top perspective view of a first and second section of a drill pipe having the tool joint attached to a lower end of the first section of the drill pipe according to certain embodiments.

The drill pipe can be formed with multiple sections of tubing that are connected together. Tool joints are also commonly used to connect the different sections of drill pipe together. The drill pipe can have different inner diameters. Also, not every section of drill pipe may have the same inner diameter but can decrease in diameter. The tool joints have an inner diameter that is less than the inner diameter of the sections of drill pipe. FIG. 1 shows an example of a first section of drill pipe 101 connected to a second section of drill pipe 102 via a tool joint 103. As can be seen in FIGS. 2-4, the tool joint 103 has an inner diameter 103*a* and an outer diameter 103*b*. There can be a transition section 104 that has an inner diameter less than the drill pipe and greater than the inner diameter of the tool joint 103. The transition section 104 can be the section that transitions from the ID of the drill pipe and the ID of the tool joint. The difference between the outer diameter 103*b* and the inner diameter 103*a* defines the thickness of the tool joint. The first section of drill pipe 101 has an inner diameter 101*a* and an outer diameter 101*b*; and the second section of drill pipe 102 has an inner diameter 102*a* and an outer diameter 102*b*. As with the tool joint, the difference between the outer diameter and the inner diameter is the thickness of the drill pipe section. FIG. 5 also shows the variation of inner diameters that can be present in a single section of drill pipe and tool joints.

After a wellbore is formed, it may be desirable to perform a cementing operation. During well completion for example, it is common to introduce a cement composition into an annulus in a wellbore. In a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing. As used herein, a "cement composition" is a mixture of at least cement and water. A cement composition can include additives. As used herein, the term "cement" means an initially dry substance that develops compressive strength or sets in the presence of water. It is also important to know the location of the cement composition as it is being pumped into the wellbore to ensure that a thorough and proper cementing job is completed.

During introduction into the wellbore, it is desirable to keep different fluids from intermixing. For example, a cement composition should not mix with a spacer fluid or the drilling fluid because the properties of the cement composition and concentrations of additives in the cement composition could be altered due to intermixing. To properly cement the well, a secure seal must be introduced and held to separate the drilling mud from the cement, which is used to propel the cement down through the casing string, out the bottom of the casing string, and up into the annulus. A wiper dart can be used to accomplish this goal. These darts are generally composed of an inner mandrel, a nose, a drive cup, and two or more conical-shaped wiper cups. The wiper cups can be located circumferentially around the outside of the inner mandrel and can function to "wipe" the inside of the string and separate fluids as the dart is being pumped into the wellbore.

Wiper darts typically include multiple wiper cups with varying outer diameters in order to effectively wipe the drilling mud from the inside of the drill pipe string having different inner diameters of pipe sections. By way of example, a wiper dart will generally include two wiper cups for the pipe sections having a larger outer diameter (OD) and two more wiper cups for the tool joints having a smaller OD for a total of four wiper cups. However, because the inner diameter (ID) of the tool joints is generally much smaller than the ID of the pipe sections, when the wiper dart passes through a tool joint, the wiper cups sized for the pipe sections tend to curl up around the edges; thus, losing the integrity of the seal and do not effectively wipe the inside of the tool joint. Even though a conical-shaped wiper cup technically has more than one outer diameter, the wiping capability is limited to the edges of the cup. Therefore, a conical-shaped wiper cup can be said to only have one outer diameter, which is the OD at the edges of the cup. Thus, traditional wiper darts must include, at a minimum, 2 wiper cups with different outer diameters at the edges—namely, one having a larger OD at the edges for the pipe sections and another one having a smaller OD at the edges for the tool joints. As used herein, the "wiper cup" disclosed herein having two different diameter wiping areas does not mean a traditional, conical-shaped wiper cup that can only wipe the inside of a casing/tubing string or tool joints at the edges of the wiper cup.

As traditional, conical-shaped wiper cups slide down the pipe section and then encounter a tool joint with a smaller ID they encounter a "flowering" effect. This flowering effect describes the shape the top of the wiper cup takes as the edges bend inward forming a flower-like pattern. Thus, the pipe section cups lose their seal and cannot wipe the inside of the tool joint, so the smaller OD tool joint cups are relied on for wiping the inside of the tool joint. Once the pipe section wiper cup(s) pass completely through the tool joint and back into the larger ID pipe sections, then those wiper cups can uncurl. Additional wiper cups may also need to be included, especially when the pipe sections have different inner diameters from each other, or tool joints have different IDs from each other, or for providing a redundancy in the event the pipe section cup or tool joint cup is not centralized within the tubing string. By way of example, a wiper dart may typically need to include 5 different cups depending on the specifics of the wellbore.

There are several disadvantages to current wiper dart designs. First, having a minimum of 2 wiper cups and oftentimes 4+ wiper cups necessitate a longer inner mandrel, which increases costs and can also require specialized equipment to run such a long mandrel into the well. Second, there may need to be 10 or more different cup sizes available to accommodate a wide range of inner diameters of both pipe sections and tool joints. An operator at the wellsite or person at an assembly plant must either have all the different sized cups on hand to assemble the wiper dart, or the operator or person must ensure that the correct-sized cups are delivered to the wellsite or assembly plant. Another disadvantage is there can be supply chain issues that prevent the correct sized cups from being on hand at the wellsite or assembly plant. Third, it may not be possible to know the exact location of the wiper dart and the cement composition as the wiper dart is being pumped through the drill pipe sections and tool joints. Thus, there is a long-felt need for improved methods and wiper darts that solve the aforementioned problems.

It has been discovered that a wiper dart can include a wiper cup having at least 2 different outer diameters that effectively wipe the inside of tool joints and the pipe sections. A pressure spike can be detectable at the surface as the wiper cup transitions from the larger ID drill pipe sections to the smaller ID tool joints.

A method of tracking the location of a wiper dart in a wellbore comprising: introducing the wiper dart into a pipe string disposed within the wellbore, the pipe string comprising two or more drill pipe sections connected together via one or more tool joints, wherein the wiper dart comprises: an inner mandrel; and a wiper cup located circumferentially around the outside of the inner mandrel, wherein the wiper cup has a cup profile comprising a first outer diameter and a second outer diameter, wherein the first outer diameter is different from the second outer diameter, and wherein the first outer diameter is configured to wipe an inside of the one or more tool joints, and the second outer diameter is configured to wipe an inside of the two or more drill pipe sections; observing detectable pressure spikes as the wiper cup traverses from each drill pipe section into each tool joint; and monitoring the detectable pressure spikes to track the location of the wiper dart The various disclosed embodiments apply to the apparatus, systems, and methods without the need to repeat the various embodiments throughout. As used herein, any reference to the unit "gallons" means U.S. gallons.

Figure 6:
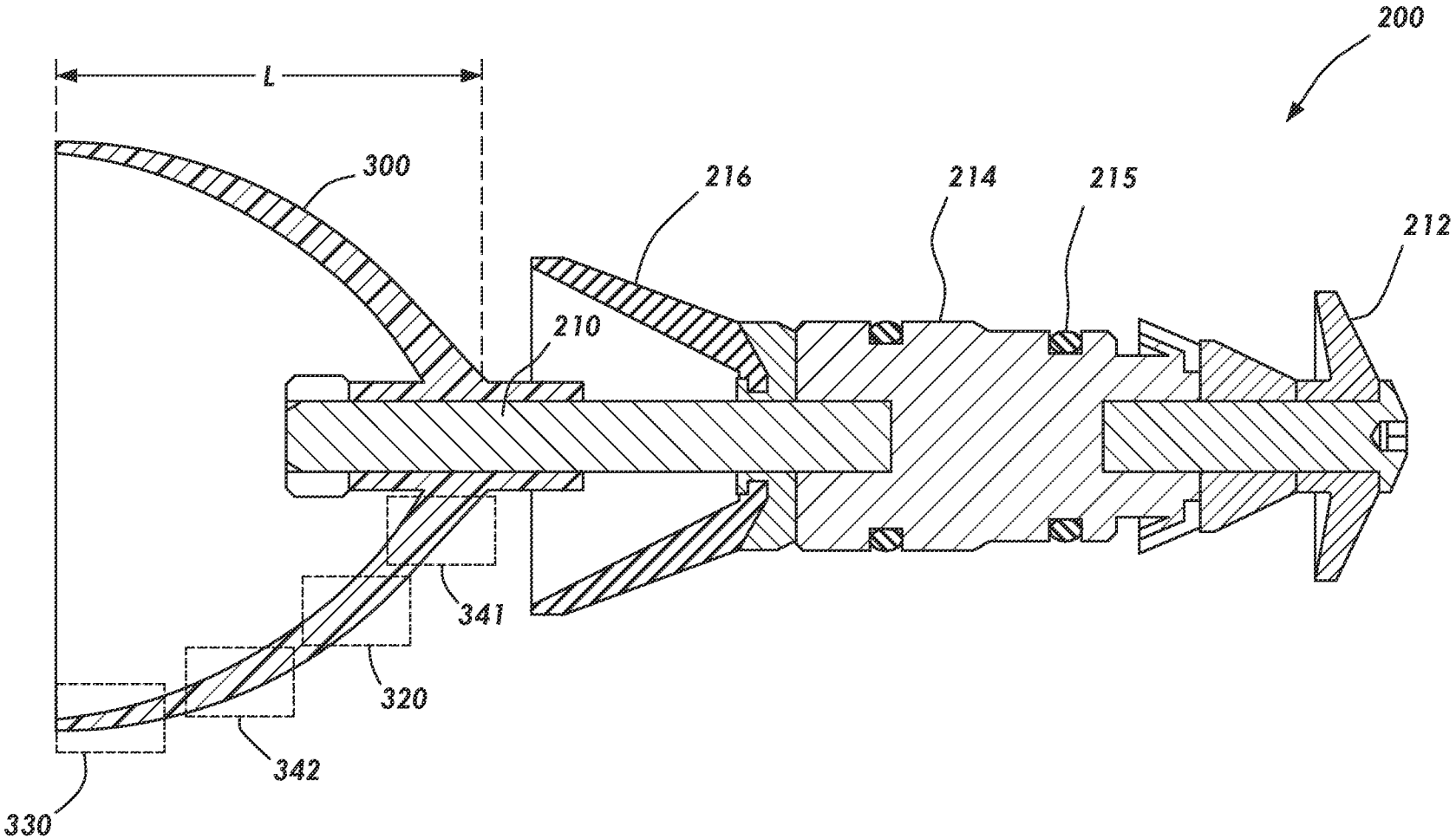
FIG. 6 is a cross-sectional view of a wiper dart with a single, bi-diameter wiper cup according to certain embodiments.

FIG. 6 is a longitudinal, cross-sectional view of a wiper dart 200 according to certain embodiments. The wiper dart 200 can include an inner mandrel 210. The inner mandrel 210 can have a variety of dimensions. The inner mandrel 110 can be made from metals, metal alloys, hard plastics, composites, or fiber reinforced resins for example.

The wiper dart 200 can include a centralizer 212 located at a first end of the inner mandrel 210. The centralizer 212 can keep the wiper dart 200 centralized within a pipe string as the wiper dart 200 is being introduced into the pipe string.

The centralizer 212 can be connected to the inner mandrel 210, for example via a connector 214 and one or more lock rings 215. The drill pipe string can be made up of two or more pipe sections connected together via one or more tool joints, for example as shown in FIGS. 1-5. The pipe string is disposed within the wellbore that penetrates a subterranean formation. As shown, the inner diameter (ID) 103*a* of the tool joint 103 is less than the ID 101*a*/102*a* of the first and/or second drill pipe sections 101/102. A transition section 104 can be located at one end of each drill pipe section and funnel into the tool joint 103. The transition section 104 can have an ID that is less than the ID 101*a*/102*a* of the first and/or second drill pipe sections 101/102 and greater than the ID 103*a* of the tool joints 103. There can be a multitude of drill pipe sections and a multitude of tool joints that connect the drill pipe sections together. It is to be understood that not every one of the drill pipe sections need to have the same ID and not every one of the tool joints need to have the same ID as variation can occur for a given pipe string.

The wiper dart 200 can also include a drive cup 216. The drive cup 216 can be located adjacent to the connector 214. The drive cup 216 can be used to introduce the wiper dart 200 into the pipe string, for example by pumping a fluid behind the wiper dart 200 wherein the fluid pushes against the drive cup to push the wiper dart 200 through the drill pipe sections and tool joints to a desired location. The fluid can be, for example, a spacer fluid or a cement composition. The wiper dart 200 can be used to keep two different fluids separated from each other (e.g., a drilling fluid or mud and a spacer fluid or cement composition) and also wipe the inside of the drill pipe sections and the tool joints during introduction. Pumping of the wiper dart 200 can be accomplished via one or more pumps.

With continued reference to FIG. 6, the wiper dart 200 can include a wiper cup 300 located circumferentially around the outside of the inner mandrel 210. According to any of the embodiments, the wiper dart 200 does not include a first wiper cup having edges with a first outer diameter (OD) and a second wiper cup having edges with a second outer diameter. By way of example, the wiper dart would not include a first wiper cup having edges with an OD of 4.5 inches and a second wiper cup having edges with an OD of 2.5 inches. Instead, a single wiper cup 300 has a first OD and a second OD, wherein the first outer diameter is configured to wipe an inside of the one or more tool joints, and the second outer diameter is configured to wipe an inside of the two or more drill pipe sections. As used herein, the drive cup 216 is not considered to be a wiper cup. The wiper cup 300 can be slid, threaded, or molded onto the outside of the inner mandrel 210. The wiper cup 300 can be made of commonly known materials, for example, natural or synthetic rubber, urethane elastomers, or plastics that provide flexibility to the wiper cup 300. The wiper cup 300 can be connected to the inner mandrel 210, for example via a wiper cup connector (not shown). The wiper cup connector can constrain the wiper cup 300 on the outside of the inner mandrel 210 and prohibit or prevent movement along a longitudinal axis of the inner mandrel 210. Other components can be used to constrain the wiper cup 300 on the outside of the inner mandrel 210.

Figure 7:
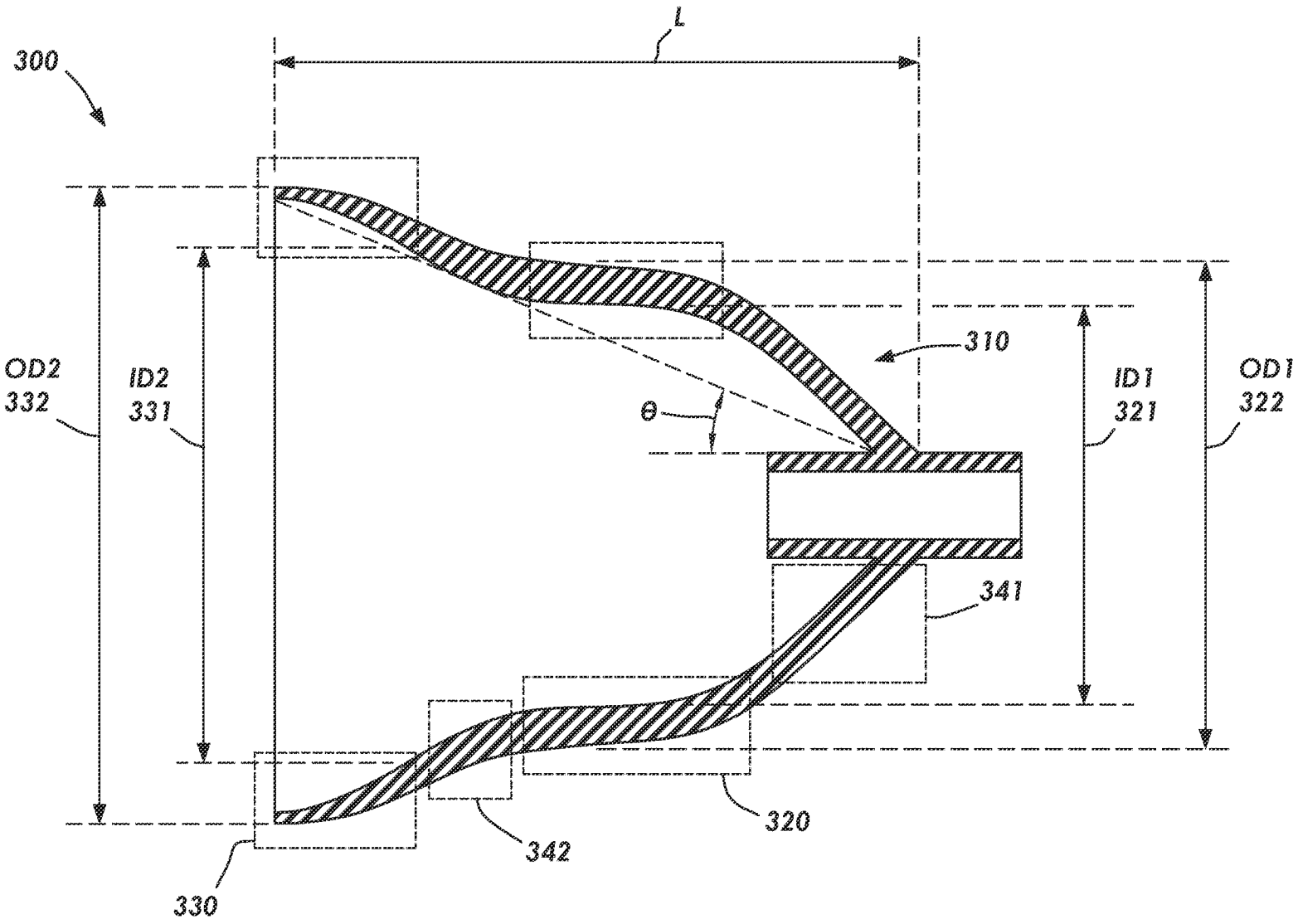
FIG. 7 is a cross-sectional view of the bi-diameter wiper cup according to certain embodiments.

With reference to FIGS. 6 and 7, the wiper cup 300 has a cup profile 310 that includes a first outer diameter (OD) 322 and a second OD 332. The wiper dart 200 can have two wiper cups 300 with the same first OD 322 and second OD 332 to increase stability of the wiper dart. Having two wiper cups can help the inner mandrel 210 track better and be more centralized as the wiper dart is being introduced through the tubing string and tool joints. The wiper cup 300 can include a first diameter area 320 and a second diameter area 330. The first OD 322 can be within the first diameter area 320, and the second OD 332 can be within the second diameter area 330. The first diameter area 320 can have a uniform or mostly uniform OD, and the second diameter area 330 can have a uniform OD or mostly uniform OD. The first OD 322 is different from the second OD 332. As can be seen, the first OD 322 can be less than the second OD 332. It is to be understood that unlike a conical-shaped wiper cup that is only capable of sealing and wiping at the edges of the cup for a specific size inner diameter, a single wiper cup 300 is capable of sealing and wiping not only at the edges but at both of the first diameter area 320 and a second diameter area 330. In this manner, a single wiper cup 300 can seal and effectively wipe the inside of both a pipe section and a tool joint, and therefore, the single wiper cup can replace one wiper cup for the pipe section and another wiper cup for the tool joints. Accordingly, if a typical wiper dart would require 4 total wiper cups (2 for the pipe sections and another 2 for the tool joints), then use of the novel wiper cup 300 would only require 1 cup or no more than 2 cups if improved stability was desired.

A first section 341 of the wiper cup 300 can be located between the inner mandrel 210 and the first diameter area 320. A second section 342 can be located between the first diameter area 320 and the second diameter area 330. The first section 341 can be straight or curved. The second section 342 can be straight or curved. The geometries (i.e., straight or curved) of the first section 341 and the second section 342 can be the same or different. By way of example and as shown in FIG. 6, the geometries of the first section 341 and the second section 342 are substantially the same; whereas as shown in FIG. 7, the geometries of the first section 341 is different than the second section 342.

As mentioned above, current wiper darts have to utilize at least 2 wiper cups with different ODs at the edges in order to effectively seal against the inside of the drill string and wipe the inside of the pipe sections and tool joints. Table 1 lists just a few of current wiper cup ODs at the edges of the cups and the maximum and minimum wiping ID of the pipe sections or tool joints the cup OD is capable of wiping in units of inches (in.).

TABLE 1

| Cup # | Cup OD | Maximum wiping ID | Minimum wiping ID |
|---|---|---|---|
| 1 | 5.44 | 5.26 | 4.50 |
| 2 | 4.50 | 4.32 | 3.75 |
| 3 | 5.00 | 4.82 | 4.25 |
| 4 | 4.13 | 3.95 | 3.34 |
| 5 | 3.71 | 3.63 | 3.00 |

The wiper cup 300 has the first OD 322 and the second OD 332 that are different from each other. One significant advantage to the wiper cup 300 design is that a single wiper cup 300 can be used to effectively wipe both the inside of the pipe sections and the inside of the tool joints instead of requiring at least 2 separate wiper cups to accomplish this goal. Accordingly, the first OD 322 and the second OD 332 can be selected to combine cup ODs of current wiper cups into a single wiper cup. By way of a non-limiting example, Table 2 shows how different current cup ODs can be combined by using the wiper cup having different first OD 322 and second OD 332.

TABLE 2

| Combined Cup #s | First OD | Second OD | Maximum wiping ID | Minimum wiping ID |
|---|---|---|---|---|
| 1 and 2 | 4.50 | 5.44 | 5.26 | 3.75 |
| 3 and 4 | 4.13 | 5.00 | 4.82 | 3.34 |
| 2 and 5 | 3.71 | 4.50 | 4.32 | 3.00 |

As can be seen in Table 2, by selecting a first OD 322 of the wiper cup 300 of 4.5 and the second OD 332 of 5.44, then the single wiper cup is able to wipe the insides of tool joints having an ID between 3.75 to 4.32 inches and also be able to wipe the insides of pipe sections having an ID between 4.5 to 5.26 inches. In this manner, the single wiper cup is able to take the place of two different wiper cups having a first cup OD of 5.44 and second cup OD of 4.5. Multiple different first OD 322 and second OD 332 combinations can be made to replace the need for two different wiper cups as is required with current conical-shaped wiper cups. According to any of the embodiments, the first OD 322 is in a range from 3.25 to 6 inches. According to any of the embodiments, the second OD 332 is in a range from 4 to 8 inches. There can be, but does not need to be, an overlap between the maximum and minimum wiping ID of the first OD 322 and the second OD 332. By way of example, the first OD 322 can have a minimum wiping ID of 3 in. and maximum of 3.7 in., while the second OD 332 can have a minimum wiping ID of 3.6 in. and maximum of 4.5 in. According to any of the embodiments, the first OD 322 and the second OD 332 are selected based on the inner diameter of the one or more pipe sections of the tubing string, which can be the same or different, and the inner diameter of the one or more tool joints, which can also be the same or different.

As can be seen in FIG. 7, the wiper cup 300 can have a length L. The length L can be selected to provide a desired length of the first diameter area 320 and the second diameter area 330 as well as optionally a desired distance between the first and second diameter areas 320/330, for example via the first section 341 and second section 342. The length L can be in a range of 3 to 6 inches. The first diameter area 320 and the first section 341 can be in a range of 1 to 2 inches. The second diameter area 330 and the second section 342 can be in a range of 1 to 2 inches. The first diameter area 320 can be curved such that the first OD 322 is in a range (e.g., from 2.5 to 3.5 inches) with a median OD of 3.0 inches. The second diameter area 330 can also be curved such that the second OD 332 is in a range (e.g., from 4.5 to 6.0 inches) with a median OD of 5.25 inches. The median OD can be selected such that the first OD 322 and second OD 332 (i.e., the median OD) has a desired maximum and minimum wiping ID. In this manner, the cup profile 310, first diameter area 320, second diameter area 330, median first OD 322, and median second OD 332 are capable of sealing against the inside of both the one or more pipe sections and the one or more tool joints to keep wellbore fluids separated and wipe the insides of the tubing string and tool joints based on the inner diameters of the pipe sections and tool joints.

As can also be seen in FIG. 7, the first diameter area 320 can include a first inner diameter 321 in the case of a straight first diameter area 320 or a median first ID 321 in the case of a curved first diameter area 320. The difference between the first ID 321 and the first OD 322 defines a thickness of the wiper cup 300 along the length of the first diameter area 320. The second diameter area 330 can include a second ID 331 in the case of a straight second diameter area 330 or a median second ID 331 in the case of a curved second diameter area 330. The difference between the second ID 331 and the second OD 332 defines a thickness of the wiper cup 300 along the length of the second diameter area 330. The thickness of the first diameter area 320 and the second diameter area 330 can be the same or different. The thickness of either the first or second diameter areas 320/330 can be in a range of 0.13 to 0.31 inches.

The thickness along the length of the first diameter area 320 and the second diameter area 330 can be the same or can be different at various points along the length of the diameter area. By way of example and as can be seen in FIG. 7, the thickness of the second diameter area 330 can taper from being thicker at a location closer to the second section 342 and thinner at the wiper cup's edge. A tapered thickness whereby the edge of the wiper cup has a reduced thickness can help the wiper cup pass through the smaller inner diameters of the tool joints by collapsing in at the edge, and then unfurling quicker after passage through the tool joint in order to seal against and wipe the inside of the pipe section(s).

As discussed above, the first OD 322 can be configured to wipe the inside of the one or more tool joints, and the second OD 332 can be configured to wipe the inside of the two or more pipe sections. It is to be understood that as used herein, the term "first outer diameter" of the wiper cup means the OD of the first diameter area 320 in the case when the first diameter area 320 is not curved and is instead flat or is the median OD of the first diameter area 320 when the first diameter area 320 is curved. It is to be understood that as used herein, the term "second outer diameter" of the wiper cup means the OD of the second diameter area 330 in the case when the second diameter area 330 is not curved and is instead flat or is the median OD of the second diameter area 330 when the second diameter area 330 is curved.

The methods include introducing the wiper dart into the pipe string disposed within the wellbore, wherein two or more drill pipe sections are connected together via one or more tool joints. The wellbore can penetrate a subterranean formation. The subterranean formation can be on-shore or off-shore. The pipe string can be, for example, part of a drill string or a casing string. The wellbore can be formed using a drilling fluid and a drill string. Although shown in FIGS. 1 and 4 as being only 2 pipe sections and 1 tool joint, a plurality of pipe sections and tool joints can be used to make up the tubing string. The tool joint(s) can have a smaller inner diameter than the pipe sections. The tool joints can have an ID for example in a range of 3.25 to 4 inches. The pipe sections can have an ID in a range, for example in a range of 3.64 to 3.96 inches for a 4½ inch drill pipe. Drill pipe also comes in other sizes such as 5, 5-½, 5-⅞, 6-⅝, and 8⅝ inches. Each of these different sizes can have an ID in a range similar to the range listed for the 4½ inch drill pipe. The ID of the drill pipe and the tool joints do not have to be uniform as some variance can occur within a given pipe section or tool joint. The ID of the pipe sections can be the same or different. The ID of the tool joints can be the same or different. The wellbore system can include other components.

Figure 8B:
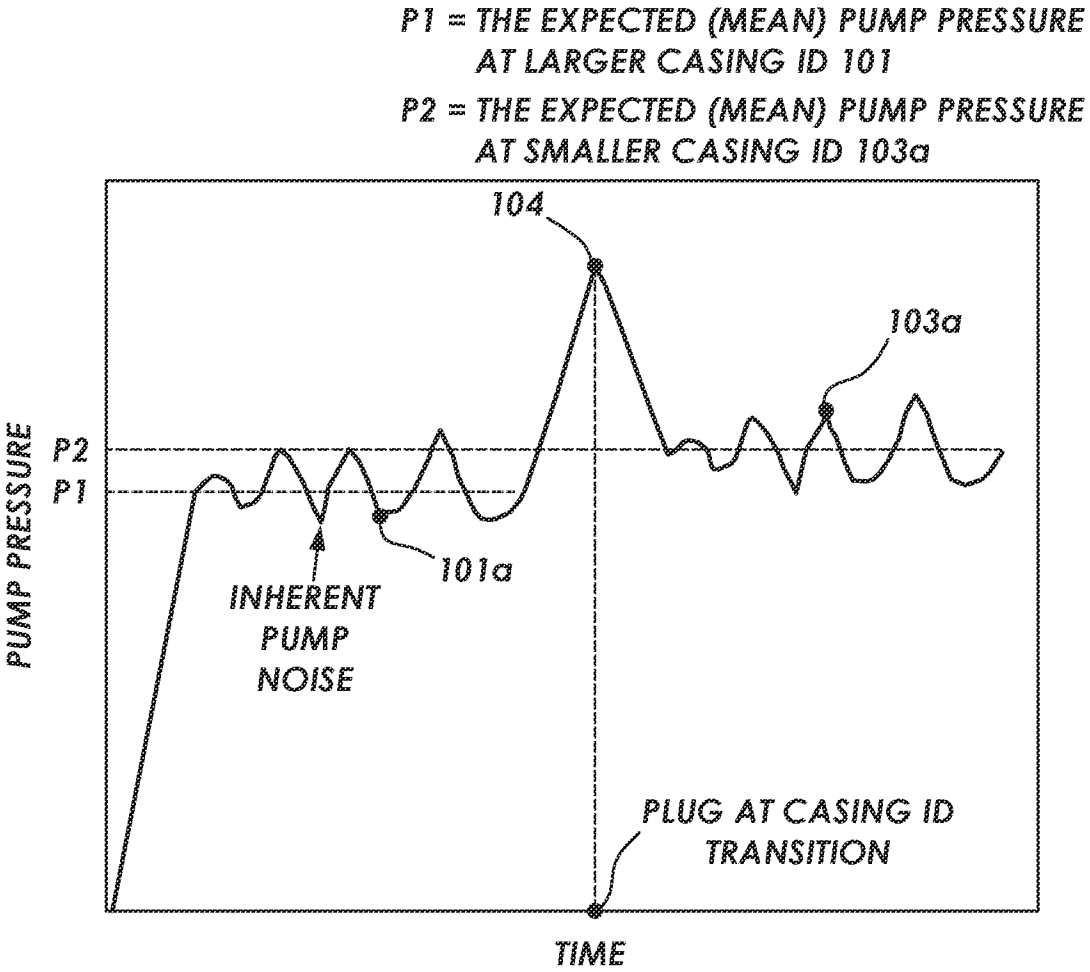
FIG. 8B is a graph of pump pressure versus time of a wiper cup as it moves through the inside of a drill pipe section, the transition, and the tool joint showing a pressure spike at the transition.
Figure 8A:
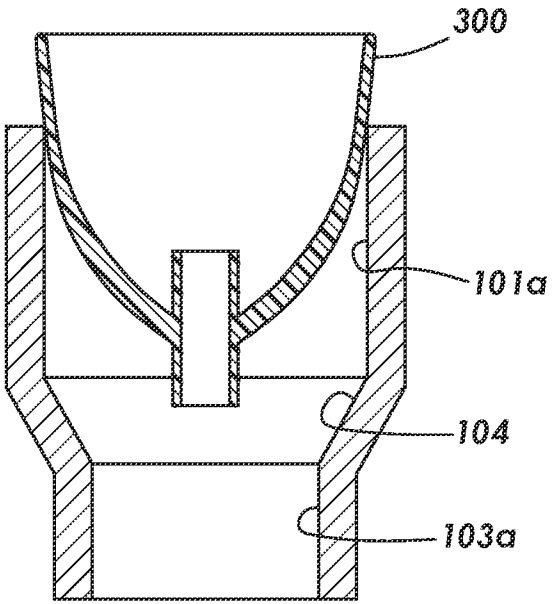
FIG. 8A is a cross-sectional view of a bi-diameter wiper cup before entering the transition from a larger inner diameter of a drill pipe section and a tool joint.

Turning now to FIGS. 8A and 8B, as the wiper cup 300 is being pumped through the inside of the drill pipe sections having a larger ID, there will be a mean pump pressure needed to push the wiper dart 200 through the pipe sections as denoted on the graph as P1. Pump rates can range, for example, from 1-2 barrels/min (42-84 gallons/min) to as high as 10-12 barrels/min (420-504 gal/min). When the wiper cup 300 begins to enter the transition section 104, more pressure is needed to push the wiper cup 300 into the tool joint 103, which can result in a detectable pressure spike that can be observed at the surface. This is because the wiper cup is having to be forced through the smaller ID 103*a* of the tool joint 103 and requires more pressure to push the wiper cup through the tool joint. Once the wiper cup 300 enters the ID 103*a* of the tool joint 103, the pressure will decrease from the pressure spike and there will be a mean pump pressure needed to fully push the wiper cup through the tool joint as denoted on the graph as P2. It is to be understood that the ID 103*a* of the tool joints 103 is less than the ID of the pipe sections and there is not a flush ID throughout the drill string.

As can also be seen on the graph, there can be minor fluctuations in the mean pipe section pump pressure P1 and in the mean tool joint pump pressure P2. This is because the ID of each pipe section and each tool joint is rarely completely and consistently uniform as minor differences in ID are common, or variances in the ID can also occur through erosion or corrosion inside the pipe or tool joint. Accordingly, in order for the pressure spike at the transition section 104 to be detectable, the increase in pressure can be a minimum increase in pump pressure to ensure that the increase in pressure is not merely the result of fluctuations of P1. According to any of the embodiments, the pressure spike is at least 40 pounds force per square inch (psi) (0.28 megapascals "MPa") greater than the highest fluctuation of P1. The pressure spike can also be at least 50 psi (0.34 MPa) greater than the highest fluctuation of P1. The pressure spike can also be a percentage greater than the highest fluctuation of P1. By way of example, the pressure spike can be 40% greater than the highest fluctuation of P1. As can be seen in the graph, P2 will generally be higher than P1. The pressure spike can also be at least 30 psi (0.21 MPa) greater than the highest fluctuation of P2. This will ensure that the pressure spike is not merely the result of fluctuations of P1 or P2.

However, too large of a pressure spike can cause strain or loss of structural integrity to the material (e.g., an elastomer) of the wiper cup itself as the cup is forced through the smaller ID 103*a* of the tool joints 103. By way of example, a pressure spike of 100 to 150 psi (0.69 to 1.03 MPa) greater than the highest fluctuation of P1 may be too much to maintain and ensure the wiping capabilities of the wiper cup and seals created in the pipe sections and tool joints. According to any of the embodiments, the pressure spike is less than a pressure that would cause adverse effects to the material of the wiper cup or cause the wiper cup to lose its sealing/wiping capability through the pipe sections at the second OD 332 or through the tool joints at the first OD 322. According to any of the embodiments, the pressure spike is less than 150 psi (0.69 MPa) greater than the highest fluctuation of P1. The pressure spike can also be less than a percentage greater than the highest fluctuation of P1, for example less than 100%. The pressure spike can also be in a range, for example within a range of 40 to 150 psi greater than the highest fluctuation of P1 or within a range of 40% to 100% greater than the highest fluctuation of P1.

It is important that a seal is created at the second OD 332 as the wiper cup 300 traverses through the pipe sections and a seal is created at the first OD 322 as the wiper cup traverses through the transition section 104 and the tool joints 103. If either of the seals are broken, then the pressure can decrease, and it may not be possible to continue displacing the wiper dart through the inside of the pipe sections and tool joints, or more importantly, the pressure spike may not be sufficient to detect at the surface. According to any of the embodiments, the geometry of the wiper cup 300 and/or different sections of the wiper cup (e.g., the first section 341, first diameter area 320, second section 342, and/or second diameter area 330) can be modified to ensure that the seals are maintained during the entire time the wiper dart 200 is pumped through the drill or casing string and the detectable pressure spike can not only be observed by an operator but also falls within the desired range of pressure (e.g., 50 to 150 psi greater than the highest fluctuation of P1) or desired range of percentage increase (e.g., 40% to 100%).

By way of a first non-limiting example, the first OD 322 of the first diameter area 320 can be slightly greater than needed to ensure the pressure spike is detectable. By way of a second non-limiting example, the thickness of the second diameter area 330 can be increased, and/or the durometer of the wiper cup at the second diameter area 330 can be increased. In this manner, some areas of the second diameter area can buckle or fold in on themselves to allow the first OD 322 of the first diameter area 320 to create a seal in the transition section 104 and tool joint 103. The wiper cup 300 can include a variety of other components, for example splines located circumferentially around the second diameter area 330, in order to increase the stiffness of the second diameter area 330. By way of a third non-limiting example and as can be seen in FIG. 7, the angle θ formed from the middle of the cup and the edges can be increased or decreased as needed to ensure a detectable pressure spike within the desired range.

The methods can further include testing the specific wiper cup design in a laboratory, with the ability to flow fluids and apply hydraulic pressure either statically or dynamically, to determine the desired range of the pressure spike greater than the highest fluctuation of P1. By way of example, if the wiper cup is generally run through the drill pipe sections at 50 psi, and the desired range of the pressure spike is 80 to 160 psi greater than the highest fluctuation of 50 psi, then the wiper cup can be tested to see if the pressure spike actually falls within the range of 80 to 160 psi. The desired range can be selected at the low end to ensure the wiper cup fully wipes the inside of the drill pipe sections and tool joints, creates an effective seal, and is detectable; and at the high end of the range to ensure that degradation or permanent damage does not occur to the cup, which could cause the cup to lose its sealing/wiping capability. Thus, when the specific cup design is tested, if the pressure spike is below the minimum range, for example less than 80 psi, this indicates that the cup is too soft, and the stiffness should be increased. The stiffness can be increased, for example, by increasing the thickness of the second diameter area 330, increasing the durometer of the second diameter area 330, adding additional components such as splines, or increasing the angle θ. Conversely, if the pressure spike during testing is above the maximum range, for example greater than 160 psi, this indicates that the cup is too stiff, and the stiffness should be decreased. The stiffness can be decreased, for example, by decreasing the thickness of the second diameter area 330, decreasing the durometer of the second diameter area 330, or decreasing the angle θ. The entire design of the wiper cup can be modified to ensure that the pressure spike is not only detectable but also falls within the desired range above the highest fluctuation of the background noise.

The methods are for tracking the location of the wiper dart in the wellbore. By identifying the wiper dart's depth, operators can prepare for subsequent wellbore operations to commence. For example, when using a bottom plug releasing dart to release the bottom plug of a sub-surface operation, an operator can anticipate when to slow down displacement rates for plug landing and when to expect a pressure increase to launch the bottom plug. Whereas, if the displacement dart's location is unknown, then operators can only estimate the plug's location based on volumes of fluids being pumped. However, pump efficiency, tubular volumes, and fluid rheology can all affect these estimates; thus, leaving the operator with no way to precisely or accurately determine the wiper dart's location. Therefore, there is a need to more accurately track the location of the wiper dart.

The methods include observing the detectable pressure spikes as the wiper cup traverses from each drill pipe section into each tool joint. An operator at the surface can observe the changes in pump pressure and see when a pressure spike occurs. When the operator observes a detectable pressure spike, for example by having estimated the pressure spike will be 50 psi greater than the highest fluctuation of P1, the operator can begin counting the number of pressure spikes. The methods include monitoring the detectable pressure spikes to track the location of the wiper dart. By way of example, the operator can take the number of observed, detectable pressure spikes in conjunction with the length of each pipe section having a tool joint at the end of each pipe section, the total number of pipe sections and tool joints, and the desired final location within the drill or casing string to specifically and accurately determine the location of the wiper dart 200 as it is pumped through the string. By way of example, common pipe section lengths can range from 30 to 35 feet (9.1 to 10.7 meters) and depending on the pump rate, a pressure spike may be observable every 5 to 6 seconds. Accordingly, if an operator observes 3 detectable pressure spikes, then the operator will know that the wiper dart is 90 to 105 feet (27.4 to 32.0 meters) down the pipe string. The operator can also know the depth of the tool to be activated and then calculate the total number of pressure spikes that would need to be observed to know when the wiper dart is at the location of the tool.

The methods can include forming the wellbore with a drilling fluid. The methods can include installing the two or more pipe sections and tool joints in the wellbore. The step of introducing the wiper dart can include pumping a fluid from a wellhead of the wellbore behind the wiper dart wherein the fluid pushes against a drive cup of the wiper dart to move the wiper dart down through the two or more drill pipe sections and the one or more tool joints. The fluid can be a spacer fluid or a cement composition. The methods can also include allowing the first OD 322 of the wiper cup 300 to wipe the inside of the tool joints and allowing the second OD 332 to wipe the inside of the one or more pipe sections.

An embodiment of the present disclosure is a method of tracking the location of a wiper dart in a wellbore comprising: introducing the wiper dart into a pipe string disposed within the wellbore, the pipe string comprising two or more drill pipe sections connected together via one or more tool joints, wherein the wiper dart comprises: an inner mandrel; and a wiper cup located circumferentially around the outside of the inner mandrel, wherein the wiper cup has a cup profile comprising a first outer diameter and a second outer diameter, wherein the first outer diameter is different from the second outer diameter, and wherein the first outer diameter is configured to wipe an inside of the one or more tool joints, and the second outer diameter is configured to wipe an inside of the two or more drill pipe sections; observing detectable pressure spikes as the wiper cup traverses from each drill pipe section into each tool joint; and monitoring the detectable pressure spikes to track the location of the wiper dart. Optionally, the wiper dart further comprises a second wiper cup located circumferentially around the outside of the inner mandrel, wherein the second wiper cup has a cup profile comprising a first outer diameter and a second outer diameter, wherein the first outer diameter is different from the second outer diameter, wherein the first outer diameter is configured to wipe an inside of the one or more tool joints, and the second outer diameter is configured to wipe an inside of the two or more drill pipe sections, wherein the first outer diameter of the second wiper cup is the same as the first outer diameter of the wiper, and wherein the second outer diameter of the second wiper cup is the same as the second outer diameter of the wiper. Optionally, an inner diameter of the tool joint is less than an inner diameter of the pipe section. Optionally, the first outer diameter is less than the second outer diameter. Optionally, the wiper dart further comprises a drive cup. Optionally, the wiper dart further comprises a first diameter area and a second diameter area, wherein the first outer diameter is within the first diameter area and the second outer diameter is within the second diameter area. Optionally, the first diameter area is curved, wherein the first diameter area has a plurality of outer diameters, and wherein the first outer diameter is a median outer diameter. Optionally, the second diameter area is curved, wherein the second diameter area has a plurality of outer diameters, and wherein the second outer diameter is a median outer diameter. Optionally, the first outer diameter is selected such that the first outer diameter area has a maximum and minimum wiping inner diameter, and wherein the second outer diameter is selected such that the second outer diameter area has a maximum and minimum wiping inner diameter. Optionally, the first diameter area comprises a first inner diameter and the difference between the first inner diameter and the first outer diameter defines a thickness of the wiper cup along a length of the first diameter area, and wherein the second diameter area comprises a second inner diameter and the difference between the second inner diameter and the second outer diameter defines a thickness of the wiper cup along a length of the second diameter area. Optionally, the thickness of the second diameter area is greater than the first diameter area. Optionally, the first outer diameter is in a range from 3.25 to 6 inches. Optionally, the second outer diameter is in a range from 4 to 8 inches. Optionally, introducing comprises pumping the wiper dart through the inside of the two or more pipe sections having a first mean pump pressure and through the inside of the one or more tool joints having a second mean pump pressure. Optionally, the second mean pump pressure is greater than the first mean pump pressure. Optionally, the first mean pump pressure and second mean pump pressure comprise fluctuations in the pump pressure. Optionally, the detectable pressure spike is in a range of 40 to 150 pounds force per square inch (0.28 to 0.69 megapascals) greater than the highest fluctuation of the first mean pump pressure. Optionally, monitoring the detectable pressure spikes comprises counting the number of pressure spikes that are observed. Optionally, the methods further comprise: collecting information on the length of each drill pipe section disposed within the wellbore; the total number of pipe sections and tool joints making up the pipe string; and the desired final location of the wiper dart within the pipe string; and using the total number of observable pressure spikes to determine the location of the wiper dart within the pipe string as the wiper dart is being introduced. Optionally, the methods further comprise collecting information on a depth of a tool to be activated within the pipe string; calculating the total number of detectable pressure spikes that would need to be observed; and counting the number of detectable pressure pulses to determine when the wiper dart has reached the location of the tool.

Therefore, the various embodiments are well adapted to attain the ends and advantages mentioned as well as those that are inherent therein. The particular embodiments disclosed above are illustrative only, as the various embodiments may be modified and practiced in different but equivalent manners apparent to those skilled in the art and having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more pipe sections, outer diameters, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A method of tracking the location of a wiper dart in a wellbore comprising:

introducing the wiper dart into a pipe string disposed within the wellbore, the pipe string comprising two or more drill pipe sections connected together via one or more tool joints, wherein the wiper dart comprises:

an inner mandrel; and a wiper cup located circumferentially around the outside of the inner mandrel, wherein the wiper cup has a cup profile comprising a first outer diameter and a second outer diameter, wherein the first outer diameter is different from the second outer diameter, wherein an angle is formed with a vertex located on an inside of the wiper cup at the inner mandrel, a first arm of the angle extending from the vertex parallel to and along the outside of the inner mandrel, and a second arm of the angle extending from the vertex to an edge of the wiper cup, and wherein the cup profile has a curvature change between the first outer diameter and the second outer diameter along the second arm of the angle prior to introduction of the wiper dart into the pipe string;

wherein the first outer diameter seals and wipes an inside of the one or more tool joints, and the second outer diameter-seals and wipes an inside of the two or more drill pipe sections, observing detectable pressure spikes as the wiper cup traverses from each drill pipe section into each tool joint; and monitoring the detectable pressure spikes to track the location of the wiper dart.

2. The method according to claim 1, further comprising a second wiper cup located circumferentially around the outside of the inner mandrel, wherein the second wiper cup has a cup profile comprising a first outer diameter and a second outer diameter, wherein the first outer diameter is different from the second outer diameter, wherein the first outer diameter seals and wipes an inside of the one or more tool joints, and the second outer diameter seals and wipes an inside of the two or more drill pipe sections, wherein the first outer diameter of the second wiper cup is the same as the first outer diameter of the wiper cup, and wherein the second outer diameter of the second wiper cup is the same as the second outer diameter of the wiper cup.

3. The method according to claim 1, wherein an inner diameter of the tool joint is less than an inner diameter of the pipe section.

4. The method according to claim 1, wherein the first outer diameter is less than the second outer diameter.

5. The method according to claim 1, further comprising a drive cup.

6. The method according to claim 1, further comprising a first diameter area and a second diameter area, wherein the first outer diameter is within the first diameter area and the second outer diameter is within the second diameter area.

7. The method according to claim 6, wherein the first diameter area is curved, wherein the first diameter area has a plurality of outer diameters, and wherein the first outer diameter is a median outer diameter.

8. The method according to claim 6, wherein the second diameter area is curved, wherein the second diameter area has a plurality of outer diameters, and wherein the second outer diameter is a median outer diameter.

9. The method according to claim 6, wherein the first outer diameter is selected such that the first outer diameter area has a maximum and minimum wiping inner diameter, and wherein the second outer diameter is selected such that the second outer diameter area has a maximum and minimum wiping inner diameter.

10. The method according to claim 6, wherein the first diameter area comprises a first inner diameter and the difference between the first inner diameter and the first outer diameter defines a thickness of the wiper cup along a length of the first diameter area, and wherein the second diameter area comprises a second inner diameter and the difference between the second inner diameter and the second outer diameter defines a thickness of the wiper cup along a length of the second diameter area.

11. The method according to claim 10, wherein the thickness of the second diameter area is greater than the first diameter area.

12. The method according to claim 1, wherein the first outer diameter is in a range from 3.25 to 6 inches.

13. The method according to claim 1, wherein the second outer diameter is in a range from 4 to 8 inches.

14. The method according to claim 1, wherein introducing comprises pumping the wiper dart through the inside of the two or more pipe sections having a first mean pump pressure and through the inside of the one or more tool joints having a second mean pump pressure.

15. The method according to claim 14, wherein the second mean pump pressure is greater than the first mean pump pressure.

16. The method according to claim 14, wherein the first mean pump pressure and second mean pump pressure comprise fluctuations in the pump pressure.

17. The method according to claim 16, wherein the detectable pressure spike is in a range of 40 to 150 pounds force per square inch (0.28 to 0.69 megapascals) greater than the highest fluctuation of the first mean pump pressure.

18. The method according to claim 1, wherein monitoring the detectable pressure spikes comprises counting the number of pressure spikes that are observed.

19. The method according to claim 18, further comprising:

collecting information on the length of each drill pipe section disposed within the wellbore; the total number of pipe sections and tool joints making tip the pipe string; and the desired final location of the wiper dart within the pipe string; and using the total number of observable pressure spikes to determine the location of the wiper dart within the pipe string as the wiper dart is being introduced.

20. The method according to claim 1, further comprising collecting information on a depth of a tool to be activated within the pipe string; calculating the total number of detectable pressure spikes that would need to be observed; and counting the number of detectable pressure pulses to determine when the wiper dart has reached the location of the tool.

* * * * *